US006558054B2

(12) United States Patent
Haller

(10) Patent No.: US 6,558,054 B2
(45) Date of Patent: May 6, 2003

(54) METHOD FOR MANUFACTURING MAILING-READY PRINTED PRODUCTS AND ENVELOPES FOR USE WITH SUCH METHOD

(76) Inventor: Jürg Paul Haller, Jorge Juan 16, 28001 Madrid (ES)

( * ) Notice: Subject to any disclaimer, the term of this patent is extended or adjusted under 35 U.S.C. 154(b) by 0 days.

(21) Appl. No.: 09/974,421

(22) Filed: Oct. 9, 2001

(65) Prior Publication Data

US 2002/0014521 A1 Feb. 7, 2002

Related U.S. Application Data

(62) Division of application No. 09/299,458, filed on Apr. 22, 1999, now Pat. No. 6,386,771.

(30) Foreign Application Priority Data

Apr. 22, 1998 (DE) ..... 198 17 878

(51) Int. Cl.[7] ..... B41J 11/44

(52) U.S. Cl. ..... 400/76; 400/61; 400/70; 101/91; 101/369

(58) Field of Search ..... 400/76, 70, 61; 101/484, 369, 47, 91; 156/556; 283/106, 115, 116; 705/405

(56) References Cited

U.S. PATENT DOCUMENTS 3,894,905 A * 7/1975 Ehlscheid ..... 101/369
4,668,212 A * 5/1987 Kotani ..... 225/100
4,730,767 A * 3/1988 Gendron ..... 229/305
4,900,391 A * 2/1990 Mandel et al. ..... 156/364
5,054,757 A * 10/1991 Martin et al. ..... 270/45
5,118,375 A * 6/1992 Malachowski et al. ..... 156/216
5,628,249 A * 5/1997 Cordery et al. ..... 101/91
5,640,835 A * 6/1997 Muscoplat ..... 101/248
5,690,219 A * 11/1997 Harrer ..... 206/308.1
5,823,423 A * 10/1998 Murray ..... 229/303
5,865,717 A * 2/1999 Fabel ..... 493/216
6,073,421 A * 6/2000 Lee ..... 493/216
6,076,080 A * 6/2000 Morscheck et al. ..... 705/400
6,173,888 B1 * 1/2001 Fabel ..... 229/304
6,174,579 B1 * 1/2001 Slyster et al. ..... 283/106
6,338,076 B1 * 1/2002 Hidding et al. ..... 707/517
6,386,771 B2 * 5/2002 Haller ..... 101/484

FOREIGN PATENT DOCUMENTS

WO WO 93/18919 * 9/1993 ..... B41F/13/56

* cited by examiner

*Primary Examiner*—Charles H. Nolan, Jr.
(74) *Attorney, Agent, or Firm*—Gudrun E. Huckett

(57) ABSTRACT

A method for manufacturing mailing-ready printed products, that consist of at least one sheet printed on at least one side and mailed in a closed state, printing data, originating from a client, are transmitted through a network to a printing facility. The transmitted printing data are printed onto the at least one sheet. A mailing-ready printed product is produced from the at least one printed sheet. The envelope for the mailing-ready printed product is produced from at least one printed sheet folded so as to form an envelope without producing waste portions.

17 Claims, 11 Drawing Sheets

Fig.2a
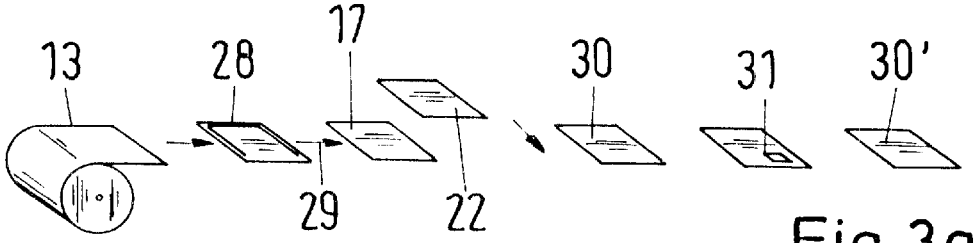
Fig.3a
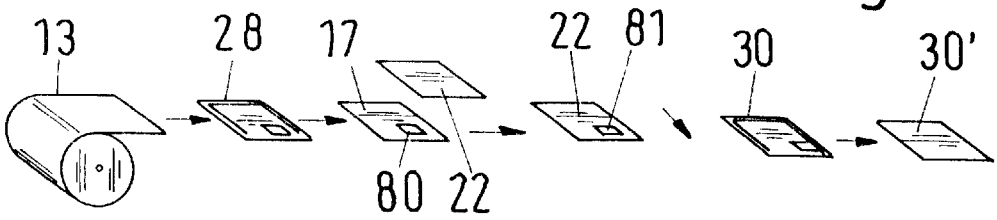
Fig.4a
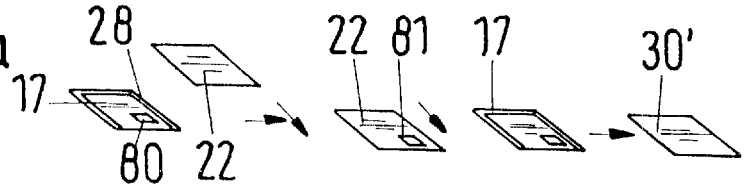
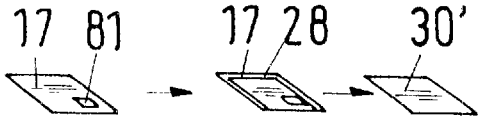
Fig.5a

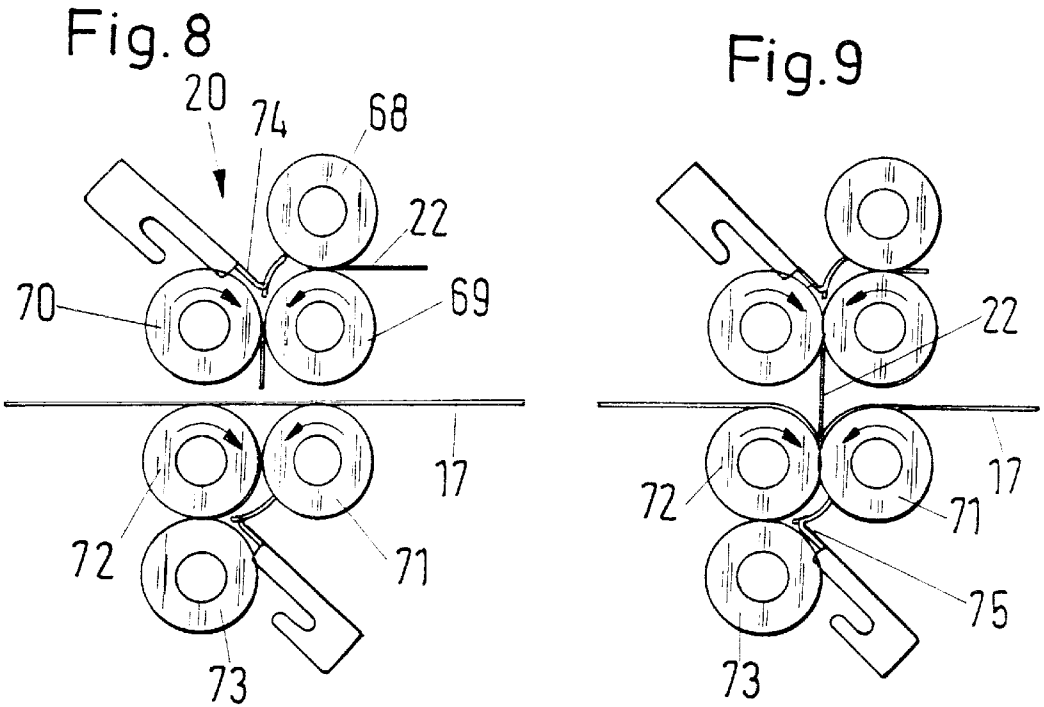
Fig.8
20
74
68
22
69
70
17
71
72
73
Fig.9
22
17
71
75
72
73
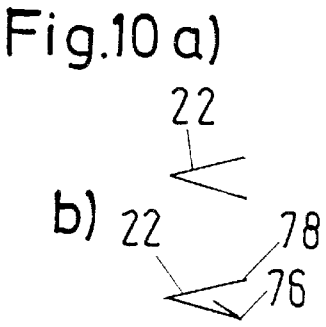
Fig.10 a)
22
b) 22
78
76
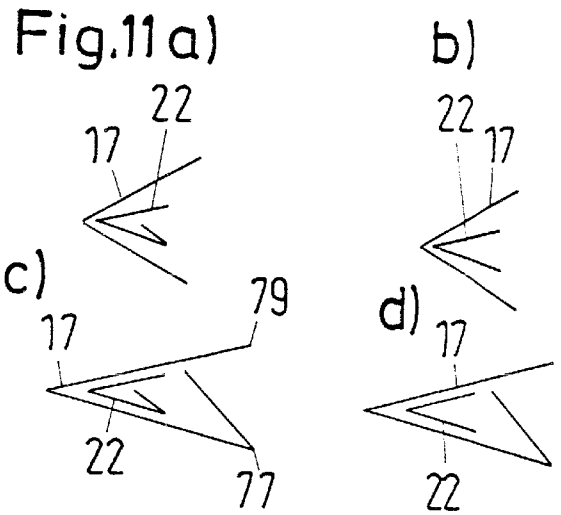
Fig.11 a)
22
17
b)
22
17
c)
17
22
79
77
d)
17
22

METHOD FOR MANUFACTURING MAILING-READY PRINTED PRODUCTS AND ENVELOPES FOR USE WITH SUCH METHOD

This application is a divisional of 09/299,458 filed Apr. 22, 1999, now U.S. Pat. No. 6,386,771.

BACKGROUND OF THE INVENTION

The present invention relates to a method for manufacturing mailing-ready printed products, wherein at least one sheet of paper, plastic etc. is printed on at least one side thereof and mailed in a closed state, whereby the printing data are produced by the client and transmitted via a network to a printing facility in which the transmitted printing data are printed onto the sheet.

It is known to submit an order for printed matter, for example, brochures, to a printing facility, whereby depending on the printing capacity of such a printing facility it may take days or weeks before the printed brochures are returned to the client. The client then must individually insert the brochures into envelopes and mail them. In certain situations it is even required to apply the addresses to the envelopes. Such methods are not only cumbersome but also cost-intensive and time-consuming.

Furthermore, a method for producing mailing-ready printed products is known in which a device is used that has a receiving unit which receives printing data via a network. The received printing data from the receiving unit are then sent to a printing unit in which the paper, for example, DIN A4 or paper of the size DIN B5 is printed in portrait format. The thus printed sheet is then inserted into an envelope. A conventional pre-manufactured product is thus introduced into the device. In the device the envelope is transported and combined with the printed insert. This method has the problem that the client must send his printing data to a certain device. When this device is already busy, the printing order cannot be immediately carried out. Therefore, there may be situations in which the client must wait for extended periods of time until his printing order is filled.

It is therefore an object of the present invention to embody a method and envelope of the aforementioned kind such that a mailing-ready printed product can be produced simply, inexpensively and fast.

SUMMARY OF THE INVENTION

This object is inventively solved in that the client transmits the printing data to a production facility suitable for performing the printing order which production facility then produces the printed product in a mailing-ready state.

The printed envelope is produced from the sheet that can be folded without producing sheet waste portions.

According to the inventive method, the client transmits prepared printing data for carrying the printing order to a suitable production facility. For example, the client can select via the network a production facility which can perform the printing order in the fastest and least expensive manner. The inventive method provides a decentralized mailing system in which the mailing-ready printed products can be produced in a plurality of printing facilities in and out of the country. The production facility produces the printed product in a mailing-ready form so that it can be directly mailed from the respective production facility. The printing data which are to appear on the printed product can already be produced by the client, for example, with a corresponding computer program.

The inventive envelope employs a tailored cutout which is not matched to the envelope to be produced but can be folded without producing waste. For example, this tailored cutout has DIN format, especially DIN A4 format, so that conventional sheets can be used for the inventive envelope or enclosure. Since the envelope is not a conventional pre-manufactured envelope, money for expensive envelopes can be saved. Moreover, it is not necessary to insert the printed materials in a cumbersome manner into the envelopes. By using the inventive enclosure or envelope, the enveloping action can be fully automatically performed without requiring any human action. This can be done in the shortest possible time and especially in a very inexpensive manner.

BRIEF DESCRIPTION OF THE DRAWINGS

The object and advantages of the present invention will appear more clearly from the following specification in conjunction with the accompanying drawings, in which:

FIG. 2*a* shows schematically the process to be used in connection with the device of FIG. 2;

FIG. 3*a* shows schematically the process to be used in connection with the device of FIG. 3;

FIG. 4*a* shows schematically the process to be used in connection with the device of FIG. 4;

FIG. 5*a* shows schematically the process to be used in connection with the device of FIG. 5;

FIG. 8 shows in a simplified representation the folding process of the folding machine according to FIGS. 6 and 7;

FIG. 9 shows a further variation of the folding process in the folding machine according to FIGS. 6 and 7;

FIGS. 10*a* and 10*b* show different folding shapes of inserts of the inventive envelopes;

FIGS. 11*a* through 11*d* show different folding shapes of the envelope with inserts;

DESCRIPTION OF PREFERRED EMBODIMENTS

The present invention will now be described in detail with the aid of several specific embodiments utilizing FIGS. 1 through 15.

Figure 1:
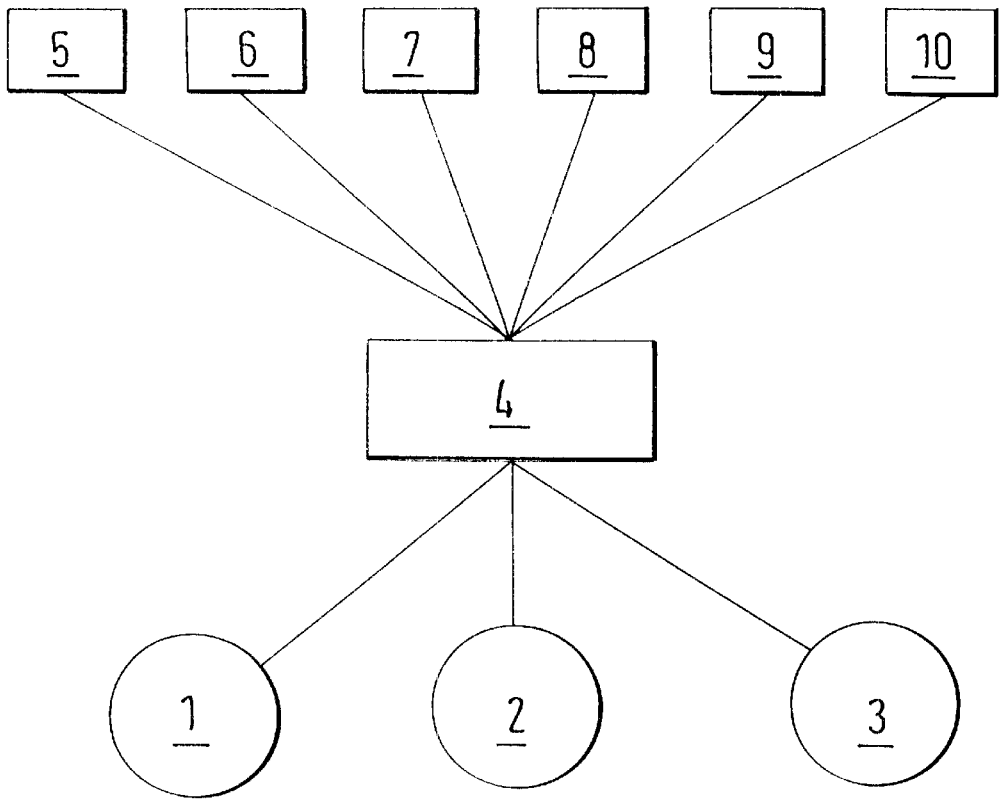
FIG. 1 shows in a schematic representation the method steps of the inventive method.

With the aid of FIG. 1 the principle method is to be disclosed for producing printed products in a simple manner and for mailing them. In the shown exemplary scenario, three clients 1 through 3 are indicated which have designed and desire to mail printed material. The clients 1 through 3 can, for example, be located in different cities within one country or can be located in different countries. Each client 1 through 3 has at least one personal computer or at least one connection to one or more central computers so that the client can design the product to be mailed with corresponding programs. The printed product can contain text and/or images, for example, in the form of cover letters, brochures etc. The personal computers are connected to the central computing unit 4. It is, of course, also possible to provide a plurality of central computing units 4 that are connected (networked). This center computing unit 4 is connected to servers 5 through 10. They can be located, for example, in a city, in different cities, or in different countries. They are provided with devices to be disclosed in the following in order to be able to print and produce in a mailing-ready ready form the desired product according to the order of the respective client 1 through 3. The client can furthermore order to have the printed product printed in different languages as a function of the country of the addressee.

For example, when the client 1 sends a printing order, he will dial up with a corresponding personal computer the central computing unit 4 and will inquire which of the production facilities, respectively, which server 5 through 10 is ready to accept the printing order. The central computing unit 4 will have information in regard to the printing capacity of the connected servers 5 through 10 and can thus select the server which is most suitable to take over the printing order submitted by the client 1. The selection of the server depends on the free printing capacity of the server. A further selection criterium may be the location of the server in order to minimize costs for the client 1. When the client 1, is for example, located in Germany, it is expedient to select a server 5 through 10 that it is also located in Germany, preferably even within the same or a neighboring city. By selecting the respective server 5 through 10 with the aid of the central computing unit 4, it is ensured that the printing order received from the client 1 can be immediately processed.

In the same manner, the central computing unit 4 can also direct further printing orders coming from other clients to a suitable server.

As soon as the corresponding server 5 through 10 has been selected, the manufacture of the printed product in its mailing-ready state can be initiated. However, it is also possible to provide a return message to the client after selection of the suitable server to the client and to request acknowledgment that the printing order should be submitted to the selected server. The client then only has to actuate the enter key on his personal computer keyboard in order to acknowledge the selection of the server for the desired printing order.

At the selected server the printing process will be fully automatically performed as will be explained in the following in more detail. The server is connected with at least one, preferably more than one, devices with which the printing process can be performed. In addition to printing of the desired product, the product is also folded into a form that is ready for mailing, and; then mailed in a suitable manner. The server thus produces the printed product in a mailing-ready form.

The transmission of the printing order from the respective, client 1 through 3 to the central computing unit 4 and from thereto the respective server 5 through 10 can be realized via the Internet, or via e-mail.

Figure 2:
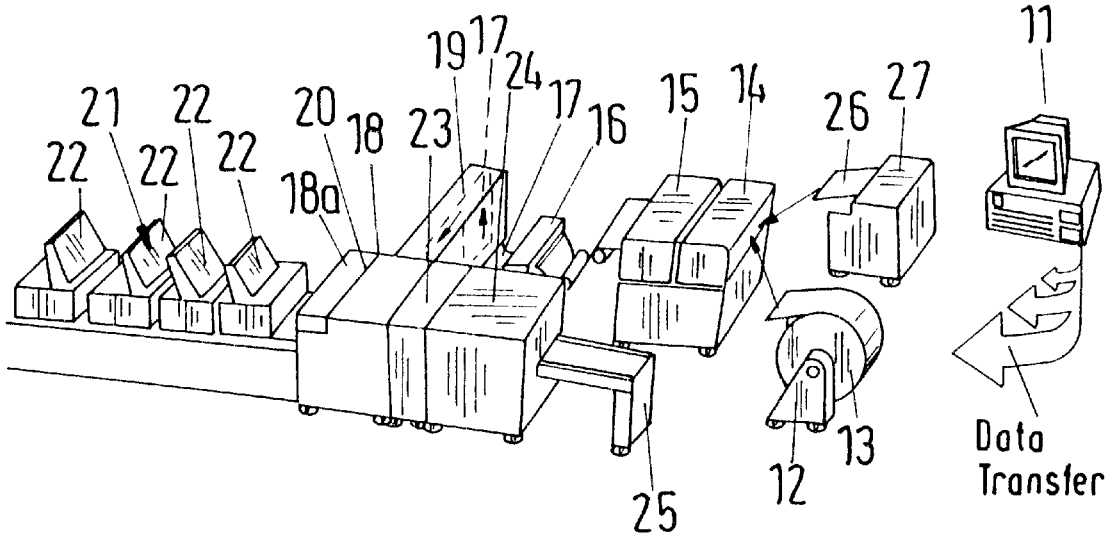
FIG. 2 shows in a simplified and perspective representation a first embodiment of the inventive device for producing the inventive envelope.

FIG. 2 shows a first embodiment of a device provided at a respective server 5 through 10. The central computing unit 4 sends the data, supplied by the respective client 1 through 3 which are to be used for printing the respective product, to a personal computer 11 connected to the server. Advantageously, the received data are saved so that they are always present for the subsequent manufacture. The device is connected to the personal computer 11 and is advantageously controlled by it. It is also possible to provide a separate computer for controlling the device. The data transmission from computer 11 to the device can then again be performed via the Internet, Intranet, or e-mail. The device has a support frame 12 on which a paper roll 13 is rotatably supported. Depending on the size of the printed product to be produced, differently sized (wide) paper rolls 13 can be used. It is thus possible to provide a plurality of such support frames 12 with correspondingly selected paper rolls 13 of different widths. The support frames can be moveable transverse to the removal direction of the paper from the roll so that the respectively required roll can be moved into the designated working position.

Instead of the individual support frames with different rolls 13 of paper having different widths, it is also possible to use only one paper roll 13 of a selected width from which the different paper format can be cut as desired. Depending on the specifications, it is possible to cut from the continuous paper sheet sequentially, for example, a DIN A4 or a DIN A3 or a DIN A5 size. A cutter 16 is thus correspondingly dynamically adjustable.

It is also possible, when using a paper roll 13, to produce by cutting off different lengths and by respectively selected folding different formats of the final product.

The continuous roll is supplied to a pasting machine 14 in which onto the paper an adhesive is applied in a desired configuration. The pasting machine 14 has arranged downstream thereof a curing device 15, in which the applied adhesive is cured. The adhesive, after curing in the curing device 15 is not yet completely cured so that during the further course of the process it is able to seal an envelope produced from the paper roll.

A cutter 16 Is positioned downstream of the curing device 15 and serves to cut the continuous paper to the desired size. The resulting individual sheets 17 are used for producing an envelope into which an insert is to be introduced. In the pasting machine 14 the application of the adhesive is carried out such that each individual sheet 17 is supplied with adhesive at the desired locations.

The individual sheets 17 leaving the cutter 16 are then fed into a folding machine 18 in which the individual sheets 17 are folded in the desired manner. The folding machine 18 has a transverse conveyor 19 in which the individual sheets 17 are received downstream of the cutter 16. The individual sheets are first transported, as indicated by the arrow in FIG. 2, in the upward direction in their initial transporting direction until they reach their end position. Subsequently, the individual sheet 17 is then transported horizontally in the direction of the arrows shown in FIG. 2 in a direction perpendicular to the supply direction into the folding unit 20 of the folding machine 18. In the folding unit 20 the respective individual sheet is then folded in the required manner.

The folding machine 18 has arranged upstream thereof a supply station 21 by which the inserts 22 are supplied in a direction perpendicular to the supply direction of the transverse conveyor 19 of the folding machine 18. The inserts 22 may be individual sheets or stacked sheets or optionally also connected sheets which have been printed as designated by the client 1 through 3. The inserts 22 can be printed by a non-represented printer which is connected to the personal computer 11. It controls the printer according to the data received via the central computing unit 4 from the respective client 1 through 3 so that the sheets are printed according to the order submitted by the client. The individual sheets are then guided from the non-represented printer into the supply station 21, whereby the supply station 21 is essentially known and will therefore not be described in detail in this context. Between the supply station 21 and the folding machine 18, a reader 18*a* is provided which can read already printed addresses on the inserts 22 and can submit these readouts to the printing station 23.

Within the folding machine 18 the inserts 22 are then placed onto the individual sheets 17 which are folded here. In this manner a ready-to-mail product is produced that can be immediately mailed after completion of manufacture.

After insertion of the inserts 22 and folding of the individual sheets 17, the product to be mailed reaches the printing station 23 in which the address of the receiver of the printed product will be printed on the individual sheet 17 that is now in the form of an envelope. The printing station 23 can be designed such that it prints address labels which are then placed directly onto the folded individual sheet 17. The printing station 23 receives the required data from the reader 18*a* or also from the personal computer 11.

Subsequently, the envelope is introduced into a pressing station 24 in which the folded individual sheet 17 is pressed together. The contacting parts of the individual sheets 17 are thus sealingly connected to one anther by the adhesive applied by the pasting machine.

The final product, after leaving the pressing station 24, is then guided into a removal device 25. The final products are then guided into a postage unit where the end products are provided with the correct postage. From this location, the products, already provided with postage, can then be submitted to a buffer station or can be directly supplied to a delivery facility. It is possible to connect the postage station also to the personal computer 11 so that the end product is fully automatically provided with postage according to the address printed by the printing station 23.

In the disclosed example, the paper roll 13 is not yet printed and serves only as a protective envelope for the respective insert 22. However, it is also possible to print the paper coming from the paper roll 13. This can be realized such that printing is already performed during production of the paper roll 13 or realized during passage through the disclosed device. In this case, the pasting machine 14 would have a corresponding printer arranged upstream thereof in which the continuous paper sheet is printed.

Furthermore, it is possible to employ for the envelope of the inserts 22 not only a continuous paper roll 13, but individual sheets 23 which are then printed by a printer 27. The printer 27 is arranged upstream of the pasting machine 14 so that the individual sheets 26 after printing are introduced into the pasting machine 14. In this case, the cutter 16 is no longer required so that he individual sheets 26, after passing through the curing device 15, can be directly submitted to the transverse conveyor 19 of the folding machine 18.

It is also possible to design the device such that selectively the paper roll 13 or the individual sheets 26 are used. In this case, data supplied by the personal computer 11 are then submitted either to the printer 27 or the paper roll 13 on the support frame 12, and the selected device is then moved into a position upstream of the pasting machine 14. When individual sheets 26 are processed in the device, it is possible to disable the cutter 16 so that the individual sheets will pass through the cutter 16 without being cut.

FIG. 2*a* shows schematically the process to be used in connection with the device according to FIG. 2. A continuous paper sheet is removed from the paper roll 13 and is then supplied with adhesive 28 in the pasting machine. According to the size of the envelope to be produced, the adhesive application is such that the envelope after folding will be reliably glued or sealed at the three open sides. In the shown embodiment, the adhesive 28 is applied in a U-shape as a thin strip so that this adhesive strip after cutting is positioned at the edge of the resulting individual sheet 17. The insert 22 is inserted perpendicularly to the transport direction 29 of the individual sheet 17. The individual sheet 17 is then folded such that the insert 22 is covered on both sides by the envelope. In this manner, a final product 30 is produced on which the address 31 is then to be applied in the manner disclosed above. Subsequently, the folded end product 30 is pressed by the pressing station 24 so that the end product 30 is sealed at all open sides and is thus in a completely closed state. The sealed end product 30' is then transported away by the removal device 25 (FIG. 2).

The continuous sheet coming from the paper roll 13 is designed such that in the end product 30' the insert 32 cannot be read from the outside. Accordingly, it is therefore suitable for use by insurance companies, banks etc. for the purpose of mailing account statements, bank statements, deposit statements, insurance certificates etc. The envelope is in any case so wide that it projects past the insert 22 at all sides and that at the projecting edges the sealing action can be realized.

Figure 12:
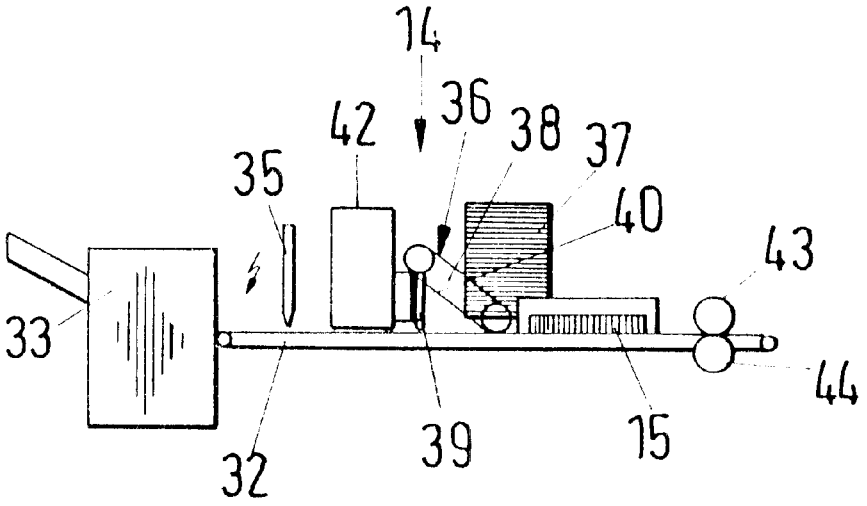
FIG. 12 shows in a side view and in a simplified representation a pasting machine of the inventive device.
Figure 13:
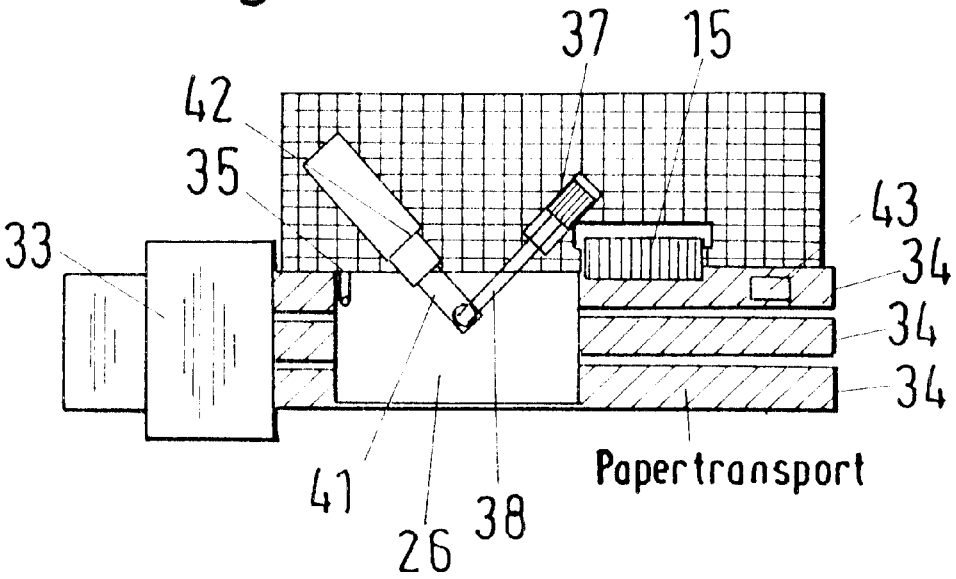
FIG. 13 shows a plan view onto the pasting machine according to FIG. 12.

FIGS. 12 and 13 show an embodiment of a pasting machine 14 and a curing device 15. A continuous paper sheet removed from the paper supply 33 is transported on a transport path 32 to the pasting machine 14. The paper supply 33 can be the support frame 12 with the paper roll 13, as represented in FIG. 2. The transport path 32 can be, for example, embodied by three adjacently positioned conveyor belts 34 (FIG. 13) which are embodied as endless belts.

The continuous paper sheet is first guided through a high voltage device 35 in order to discharge the paper at least in the area of the adhesive application. In the transporting direction downstream of the high voltage device 35 a pasting machine 36 is provided with which the adhesive contained in a reservoir 37 is applied. The pasting machine 36 has a jointed arm 38 which is provided with a downwardly extending supply tube 40 which has a ball valve 39 positioned at its end. The ball valve 39 rests on the paper and applies the adhesive. At the free end of the jointed arm 38 a second jointed arm 41 is connected which is part of a vibrator 42. The two jointed arms 38, 41 are pivotable relative to one another about a vertical axis. It is thus possible to move the supply tube 40 with ball valve 39 to any desired location on the continuous paper sheet in order to apply the adhesive. Control is realized by the personal computer 11. The vibrator 42 ensures that the adhesive is reliably applied via the supply tube 40 and the ball valve 39.

The curing device 15 in the embodiment is a heating device through which the respective area of the continuous paper sheet to which the adhesive has been applied is transported. In the shown embodiment according to FIGS. 12 and 13, the adhesive is applied to only one longitudinal edge of the continuous paper sheet in the transporting direction so that the curing unit 15 is provided only in this area.

Subsequently, the continuous paper sheet is guided through pressure rollers 43 and 44 which rotate about a horizontal axis.

As can be seen in FIG. 13, instead of the paper roll 13 individual sheets 26 can be transported through the pasting machine 14 and the curing device 15.

Figure 6:
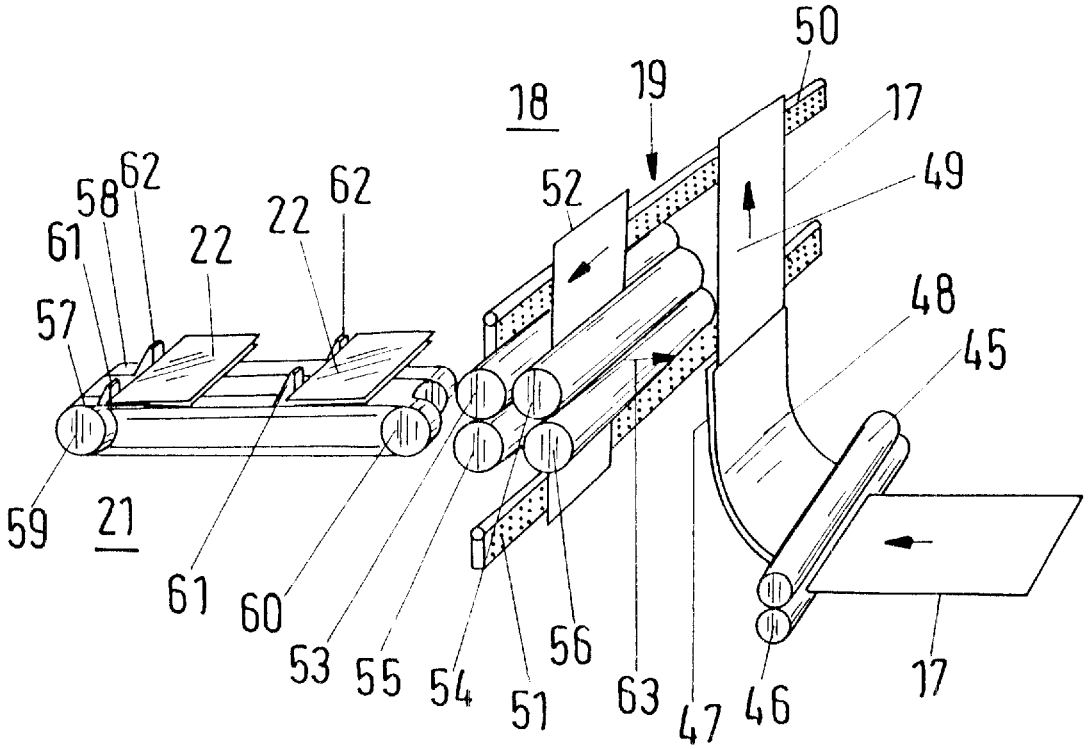
FIG. 6 shows in a schematic representation a folding machine of the inventive device.

FIG. 6 shows that the sheet 17 exiting from the cutter 16 is transported by the transverse conveyor 19 within the folding machine 18. The individual sheet 17 cut by the cutter 16 (FIG. 2) is then guided between the two rollers 45, 46 which are part of the transverse conveyor 19 and are positioned horizontally. Both rollers 45, 46 are driven in rotation and transport the individual sheet 17 between two curved guide plates 47 and 48 which bring the individual sheet 17 into a vertical position. Since the guide sheets 47, 48 have a continuous upward curve, the individual sheet 17 will be transported without problems. It is guided into the area of two conveyors 50, 51 of the transversely arranged transporting device 49 whereby the conveyors extend parallel to one another and are positioned horizontally with spacing to one another. Both conveyors 50 and 51 are formed by an endless conveyor belt which is advantageously provided at its upper side with a friction coating in order to transport the upright sheet 17, transverse to the transporting direction 49, in the transporting direction 52. In order to securely contact the individual sheets 17 by the conveyors 50, 51, the sheet is advantageously secured in the transverse conveyor 19 by vacuum. The conveyors 50, 51 are provided with respective openings so that the sheet is subjected to vacuum.

The conveyors 50, 51 are positioned above and below horizontally arranged rollers 53 through 56 which are arranged in pairs above and adjacent to one another. The conveyors 50, 51, in relation to the rollers, are arranged such that the individual sheet 17 during transverse transport will be moved between the rollers 53, 55 and 54, 56, respectively. The spacing between the rollers is selected such that the individual sheets are secured in the gap of the rollers.

Between the rollers 53 and 55 the respective insert 22 is supplied into the supply station 21 in a direction perpendicular to the transporting direction 52. The supply station 21 also comprises conveyors 57, 58, preferably endless conveyor belts, which are guided by horizontally arranged rotatable rollers. The conveyors 57, 58 are provided with abutments 61, 62 which project transversely from the conveyor belts 57, 58 and are provided spaced apart along the belts. The inserts 22 rest at these abutments 61, 62. The conveyors 57, 58 thus move the inserts 22 between the two rollers 53, 55 of the folding machine 18. The adjustment between the transverse transport of the individual sheets 17 and the supply of inserts 22 is selected such that the insert 22 will meet the individual sheet 17 when it is positioned in the position shown in FIG. 6 between the roller pairs 53, 55 and 54, 56. Due to the transversely supplied insert 22, the individual sheet 17 is folded and is thereby pressed between the folders 54 and 56. The folded individual sheet 17 then exits from the roller gap in the direction of arrow 63 whereby the insert 22 is positioned in the folded individual sheet 17.

Figure 7:
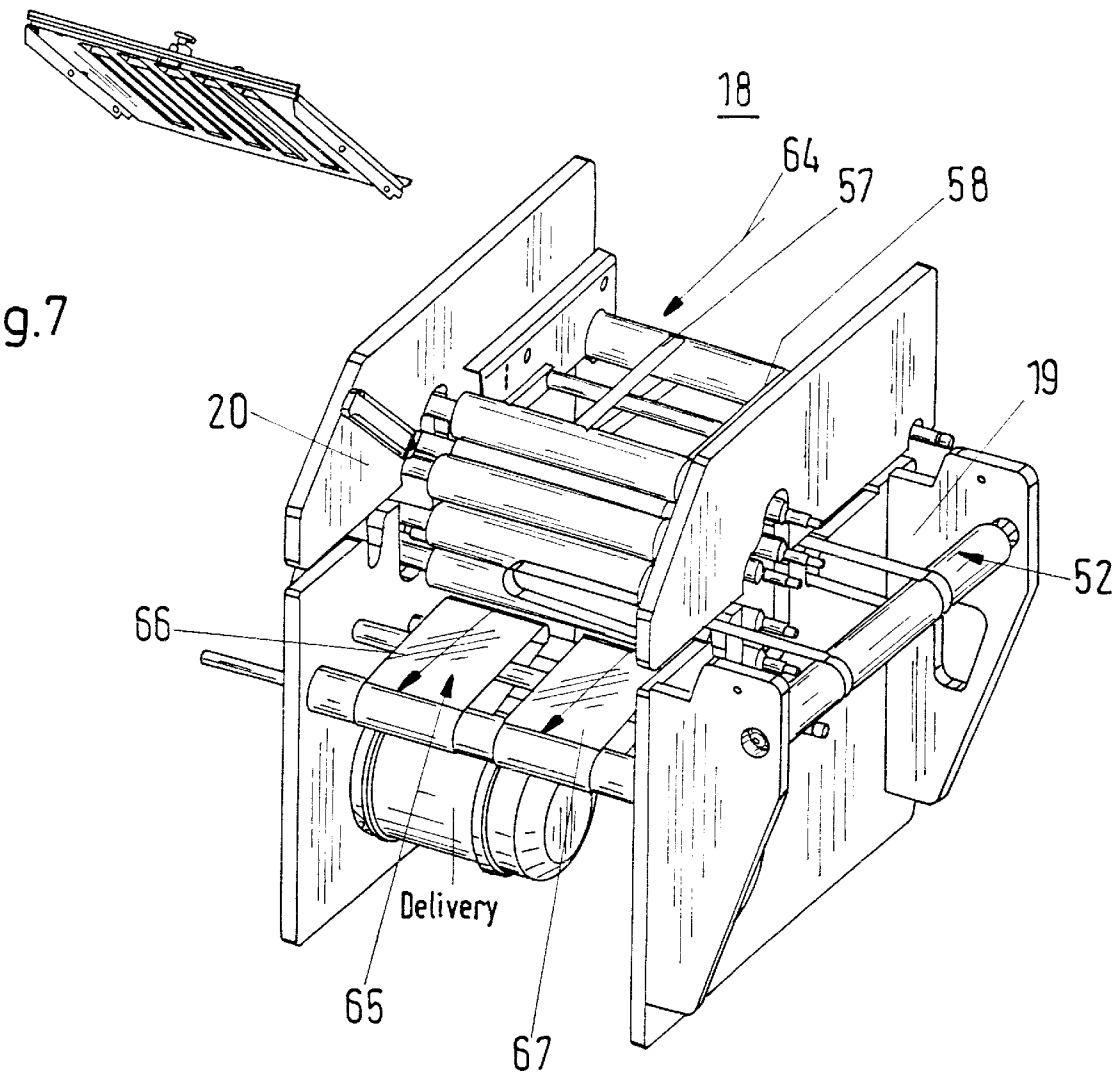
FIG. 7 shows the folding machine according to FIG. 6 in a simplified perspective representation.

FIG. 7 shows a further embodiment of the folding machine 18 with the transverse conveyor 19 and the folding unit 20. The individual sheet is transported by the transverse conveyor 19 in the disclosed manner in the direction of arrow 52 between the rollers of the folding unit 20. The non-represented insert is supplied in a direction perpendicular thereto (arrow 64) in the disclosed manner by the supply station 21. As has been described with the aid of FIG. 6, the supply of the insert 22 is carried out at the moment when the individual sheet 17 is between the rollers of the folding unit 20. With the aid of the supplied insert 22, the individual sheet is then folded between the rollers in the disclosed manner and transported away by the conveyor 65. The conveyor 65 is advantageously realized by two endless conveyor belts 66 and 67 which are spaced from one another and are driven in rotation so that the folded individual sheet with the insert positioned therebetween is guided outwardly. In the embodiment according to FIG. 2, the folded individual sheet is guided from the folding machine 18 into the printing station 23.

FIG. 8 shows how to fold the individual sheet 17 in the folding unit 20 of the folding machine by employing the insert 22. In the embodiment represented in FIG. 8, the folding unit 20 has six rollers 68 through 73 which are positioned horizontally and have rotatably driven rollers 69 through 72. The individual sheet 17 is supplied resting on the contacting rollers 71 and 72. The individual sheet 17 has a minimal spacing to the oppositely arranged rollers 69, 70. The insert 22 is horizontally guided between the rollers 68 and 69 and is directly subsequently guided by the deflecting device 74 downwardly between the two rollers 69 and 70. The two rollers 69, 70 are driven in rotation in opposite directions so that the insert 22 is reliably gripped and transported against the horizontally positioned sheet 17. The incoming insert 22 will fold the individual sheet 17, as shown in FIG. 9, in the downward direction whereby the folded area is then moved between the two oppositely rotating rollers 71, 72. They grip the folded area of the individual sheet 17 and pull it downwardly through the roller gap to a further deflecting device 75, by which the folded individual sheet 17 with the interposed insert 22 is then guided between the rollers 72 and 73. Between these two rollers 72, 73 the folded individual sheet 17 with the interposed insert 22 is transported away from the folding machine 18.

The insert 22 can be positioned in an unfolded manner into the folded individual sheet 17. However, it is also possible, as shown in FIG. 10*a*, to fold the insert 22 centrally. Also, it is possible to double the insert 22 (FIG. 10*b*).

The individual sheet 17, as is shown in FIGS. 11*a* through 11*d* can also be folded differently. According to FIG. 11*a* and 11*b*, the individual sheet 17 is folded at the middle. It can now receive the insert 22 folded according to FIG. 10*a*, as disclosed in FIG. 11*b*, or can receive the insert 22 folded according to FIG. 10*b*, as disclosed in connection with FIG. 11*a*. According to FIGS. 11*c* and 11*d*, the individual sheet 17 can also be twice folded and can receive a singly folded insert 22 (FIG. 11*d*) or the twice folded insert 22 (FIG. 11*c*).

The individual sheet 17 and the insert 22 are folded for the double folding action (FIG. 10*b*, FIG. 11*a*, FIG. 11*c*) such that in the folded state one folding edge 76, 77 is positioned at the level of the free edge 78, 79 of the individual sheet 17, respectively, of the insert 22.

Figure 3:
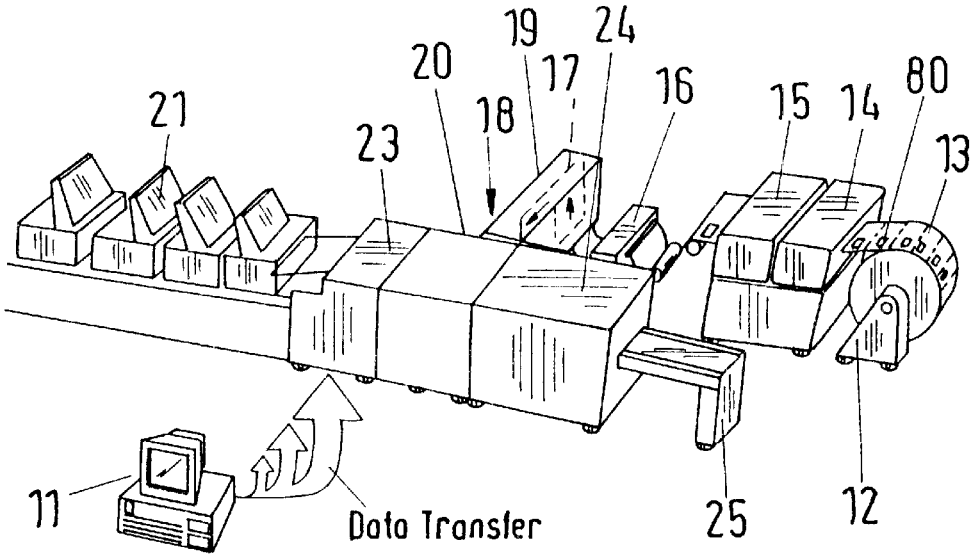
FIG. 3 through FIG. 5 show in representations corresponding to FIG. 2 further embodiments of the inventive devices for producing the inventive envelopes.

FIG. 3 shows a device in which on the frame support 12 a paper roll 13 is supported having a continuous paper sheet that is already provided with address windows 80. The continuous paper sheet, as disclosed in connection with FIG. 2, is guided in sequence through the pasting machine 14, the curing device 15, the cutter 16, the folding machine 18 with transverse conveyor 19, and the folding unit 20 as well as through the pressing station 24. The sealed final product is then transported away by the removal device 25 for further handling. In contrast to the device of FIG. 2, the pressing station 23 is arranged between the folding machine 18 and the supply station 21. The inserts supplied via the supply station 21 have the address printed thereon before introduction into the folding machine 18. The insert and the individual sheet 17 which have been cut to length from the continuous paper sheet are aligned in the folding machine 18 such to one another that after the folding step the address printed onto the insert is positioned in the address window 80 of the individual sheet 17. In other respects, the device according to FIG. 3 is identical to the embodiment of FIG. 2.

The continuous paper sheet is removed from the roll 13, as schematically shown in FIG. 3*a*, and is then provided in the pasting machine with the required adhesive application 28. In the shown embodiment, the adhesive is applied in the same shape and arrangement as in the embodiment according to FIGS. 2 and 2*a*. After separation of the individual sheet 17 with the address window 80, the insert 22 is inserted into the individual sheet 17 in the folding machine 18 in the manner disclosed in connection with FIGS. 6 through 12 and is folded to the final product 30. The insert 22 has the address 81 printed thereon before insertion into the folding machine 18. In the folding machine 18 the disclosed folding step is carried out so that the folded product 30 with the insert 22 contained therein is then guided into the pressing station 24 in which the final sealing of the final product 30' is carried out.

The pressing station 23 can be designed such that it does not print the address directly onto the insert 22 but onto labels which are then placed onto the respective location on the insert 22. The control of the device is again achieved by the personal computer 11.

Figure 4:
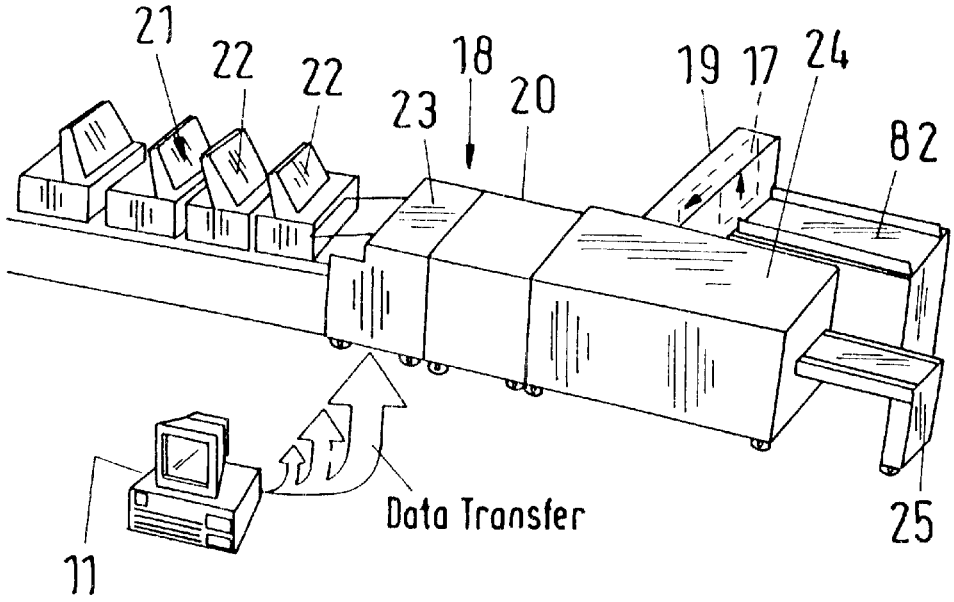

FIG. 4 shows a simplified device. In this embodiment sheets 17 that are not yet folded are used which are already supplied with the adhesive 28 (FIG. 4*a*) and an address window 80. These individual sheets 17 are guided by a supply device 82 (FIG. 4) to the folding machine 18. The folding machine 18 is again provided with a transverse conveyor 19 with which the individual sheets are transported transverse to the supply direction into the folding unit 20, as has been disclosed in the aforementioned embodiment. The supply station 21 is identical to the supply station described in the previous embodiment and guides the inserts 22 to the printing station 23. The inserts 22 are printed before entering the folding machine 18, preferably with the respective address. As in the embodiment disclosed in connection with FIG. 3, it is also possible to print in the printing station 23 the entire insert 22 in the manner ordered by the client 1 through 3 (FIG. 1). Accordingly, the supply station 21 will supply initially clean sheets as inserts 22 which are then printed in the printing station 23. Of course, it is also possible to print the inserts 22 beforehand so that in the printing station 23 only the addresses are to be printed.

In the folding machine 18 the inserts 22 are placed into the individual sheets 17 in the aforementioned manner and the sheets 17 are correspondingly folded. The pressing station 24 arranged downstream of the folding machine 18 then presses the folded product in the aforementioned manner, especially in the area of the adhesive application such that the individual sheet 17 is securely glued at all edges and is thus sealed. The removal device 25 then transports the final product to further handling stations.

As in the embodiment according to FIG. 3, the printing data are supplied via the personal computer 11 to the printing station 23 so that the inserts 22 can be designed according to the specifications of the respective client 1 through 3.

FIG. 4*a* shows again in a simplified representation the method steps for use of the device according to FIG. 4. The individual sheet 17, that has already been provided with the adhesive 28 and the address window 80, is guided to the folding machine 18 in which the insert 22 is introduced.

The address 81 is printed onto the insert 22. As disclosed above, it is also possible not only to print the address 81 but also to completely print the entire insert 22. Subsequently, folding of the individual sheet 17 during insertion of the insert 22 takes place. Finally, the final product 30' is pressed in the pressing station 24 along the adhesive edges and is thus sealed.

Figure 5:
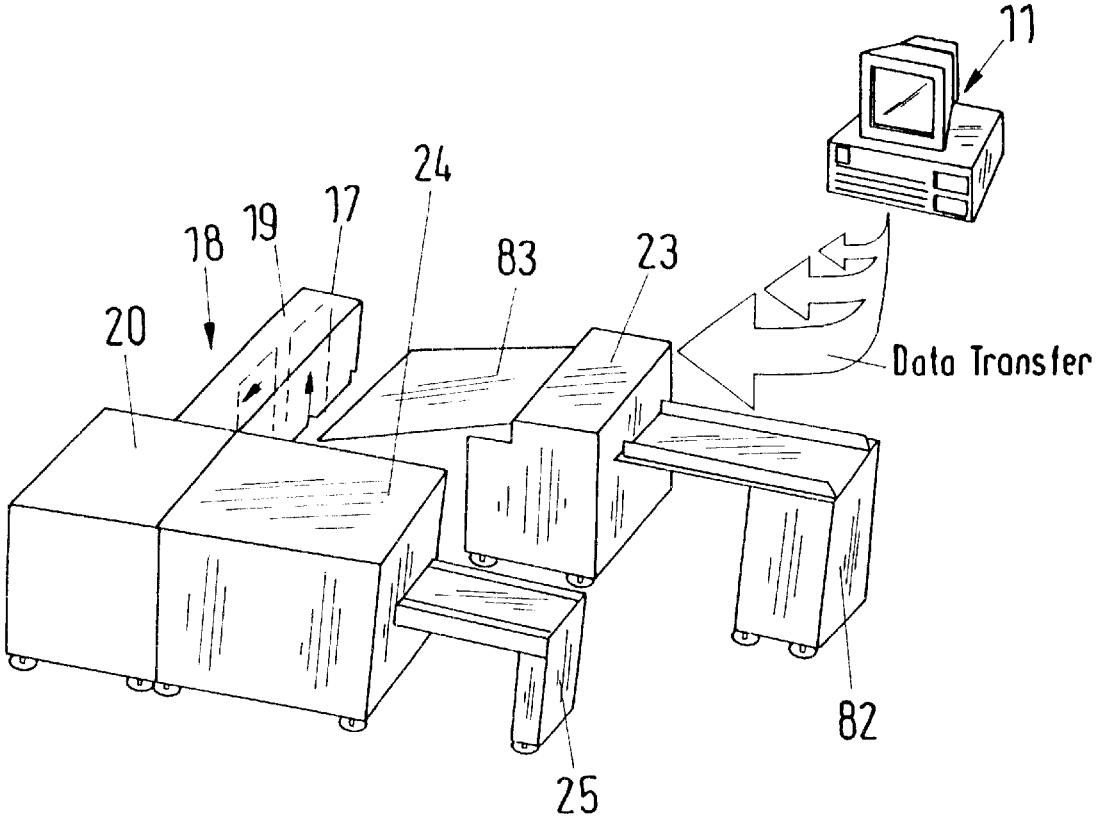

FIG. 5 shows a simplified device in which again individual sheets are used which are already provided with adhesive and an address window. These premanufactured individual sheets are supplied by the supply device 82 to the printing station 23 which, in contrast to the previous embodiment, is arranged upstream of the folding machine 18. The printing station 23 contains the printing data received from the personal computer 11. In the printing station 23 the individual sheets 17 can be printed according to the data contained in the personal computer 11.

The printed individual sheets 17 are guided from the printing station 23 via a supply device 83 to the transverse conveyor 19 of the folding machine 18. The individual sheets 17 are transported by the transverse conveyor 19 in the afore disclosed manner into the folding unit 20 in which the individual sheet 17 is folded as desired. In contrast to the previous embodiments, in this case no insert is used. Instead, the individual sheet 17 itself is the printing surface which can be printed on one side or both sides. If the printed information is secret, it will printed onto the inner side (after folding) of the individual sheet 17 so that the data after folding and sealing in the pressing station 24 arranged downstream cannot be read from the exterior. Via the removal device 25 the final product is then removed from the device and transported in the disclosed manner to further handling devices.

In the printing station 23 it is also possible to print addresses onto the individual sheets 17, according to the data provided by the client, whose data are supplied in the disclosed manner by the personal computer 11.

FIG. 5*a* shows again schematically the method steps for use of the device according to FIG. 5. The individual sheet 17 is printed in the printing station 23. In the easiest scenario the printed item is the address 81. However, it is also possible to perform in the printing station 23 the complete printing of the individual sheet 17. In this case the supply device 82 is provided with clean individual sheets.

Subsequently, the individual sheets 17 provided with the address 81 is then printed. Subsequently, the individual sheets 17 are sealed by compressing the adhesive edges 28 of the folded individual sheet 17 onto one another. In this manner the resulting end product 30' sealed on all sides is produced.

With the disclosed methods high numbers of printed products can be produced and mailed withing the shortest possible amount of time. Product output of, for example, up to 18,000 copies per hour are possible. The final product 30' is characterized in that the folded individual sheet is used as the envelope instead of a conventional envelope. The individual sheet 17 can be folded and closed in the afordescribed simple manner so that this method is very simple and especially inexpensive. Since the clients 1 through 3 are connected by the central computing unit 4 with the respectively most suitable server 5 through 10, during printing and subsequent closure (sealing) no delay result so that the printing order, even for large batches, can be completed very quickly. Despite the simple embodiment of the inventive envelope, regulations with respect to the data safety can be easily fulfilled. The data printed onto the individual sheet 17 that is folded and sealed cannot be read from the outside and can only be accessed by destruction of the enclosing individual sheet 17, i.e., the inventive envelope.

The individual sheets 17 must not be necessarily folded in order to provide an envelope for the insert 22. For example, the insert 22 can also be placed between two cover sheets 17 whereby the individual cover sheets are then glued together along their edges and are thus sealed so that the insert 22 can be used as a data carrier. Also, it is possible to print the inner (facing) sides of two individual sheets and to position an insert between the individual sheets. The individual sheets that have been printed on their inner sides are then glued together along their edges and are thus sealed. In this case, the inner sides of the respective individual sheets 17 are also used as data carriers.

It is furthermore possible to print two individual sheets on their inner (facing) sides and to connect them to one another such that the printed sides are positioned inwardly. The contacting individual sheets 17 can then be sealed by gluing them together along their edges.

The disclosed devices according to FIGS. 2 through 5 must not be positioned in proximity to the servers but also can be positioned at the location of the customer of the clients 1 through 3. In this case, the client 1 through 3 can send the printing order directly to his customer so that the printing orders can be processed there. For example, it is easily possible that within a concern the mother company will send different printing orders to subsidiary companies which are provided with the necessary devices.

The disclosed method allows mailing of confidential data without risking data safety. Since the folding step as well as the insertion of the insert 22 is carried out fully automatically, the final product 30' exits from the device at completion of the method as a completely sealed product. During the course of the method there is no possibility for a third party to access the contents of the data carriers to be mailed. As a further safety feature, it is possible to position the device in rooms that can only be accessed by authorized personnel. By eliminating the conventional envelopes as an enclosure for the inserts 22, a considerable technical simplification results because the difficult tailoring as well as folding and gluing of envelopes is no longer required. Instead, the individual sheet that is supplied either as an Individual sheet to the device or is cut to size from a continues paper sheet (paper roll 13) is used as an envelope blank.

The sealing of the final product 30' is achieved advantageously by providing an adhesive. However, other sealing possibilities are known, for example, crimping or fusing. In the latter case, the individual sheet and/or the insert is a plastic sheet that is foil-like and is employed as an individual foil or as a foil cut to size from a continuous foil.

Figure 14:
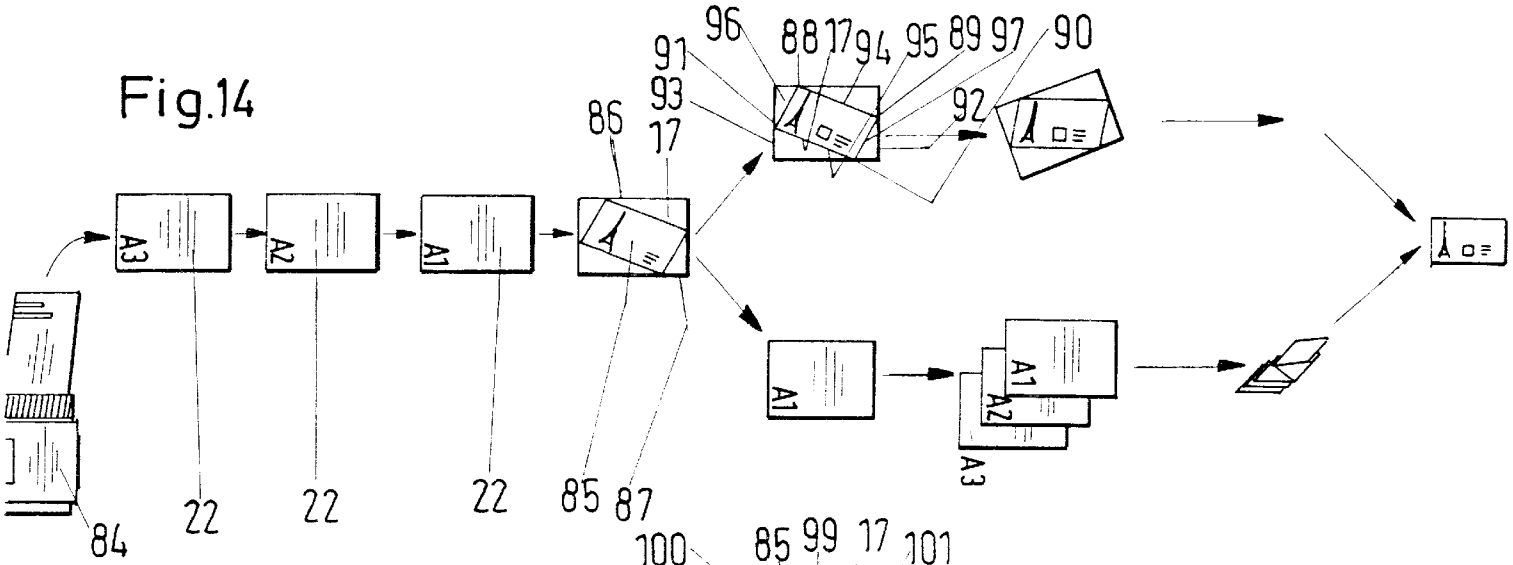
FIGS. 14 and 15 show two different methods for enveloping an insert as well as for producing the envelope.

In the step of inserting the insert 22 and folding the sheet 17 over it, the initial material for producing the envelope may be a conventional sheet, for example, a sheet of DIN A4 size. As is shown in the example of FIG. 14, the printer 84 can print the sheet 17 as desired, for example, with the required address and/or a design 85 supplied by the client. Subsequently, the printer 84 will print the inserts 22. In the shown embodiment, three inserts 22 are printed which are to be inserted into the sheet 17.

After printing, the inserts 22 are first compiled and then folded as needed. The sheet 17 is then moved onto a different transport path than the inserts 22. After folding, the inserts are placed onto the not yet folded sheet 17.

Figure 15:
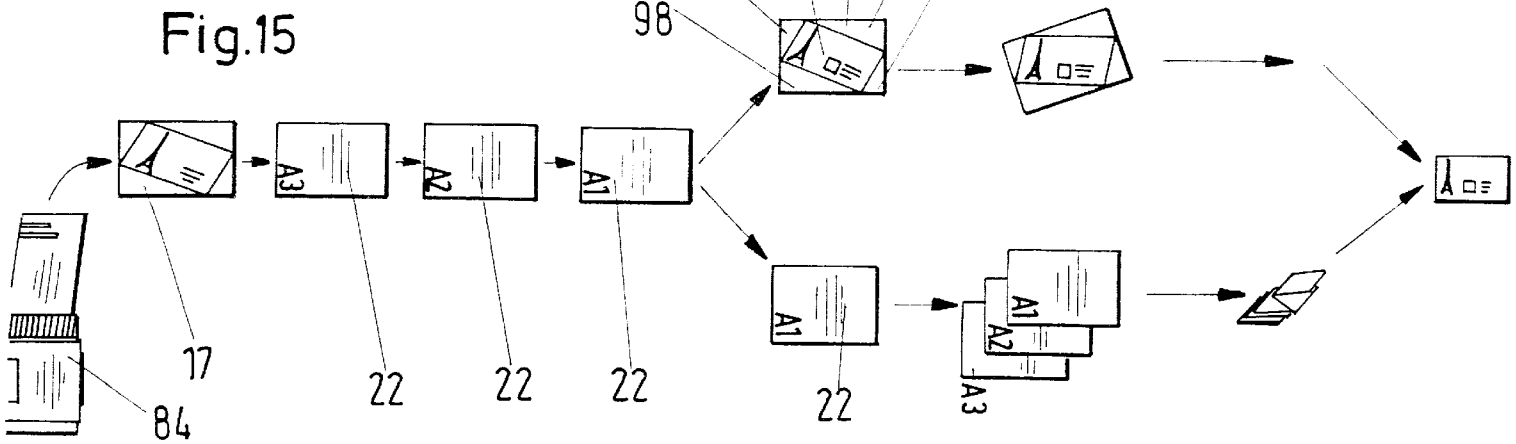

FIG. 15 shows the possibility to print in the printer 84 first the insert or inserts 22 and subsequently the sheet 17. Then, as disclosed in connection with the embodiment of FIG. 14, the transport paths of the sheet 17 and of the inserts 22 are separated and the inserts 22 are folded.

The printed design 85 on the sheet 17 is printed at a slant to the longitudinal sides 86, 87 and serves as a marking for placement of the insert or inserts 22. The printed design 85 is, for example, a rectangle and arranged such that its corners 88 through 91 are positioned on the longitudinal sides 86, 87 and the narrow sides 92, 93 of the rectangular sheet 17. The longitudinal sides 94, 95 and the narrow sides 96, 97 of the printed design 85 serve as folding lines for the sheet 17 in order to produce the envelope. The folding process can be performed in a respective folding machine.

Of course, the printed design 85 providing an orientation aid for placement of the folded insert or inserts must not be provided on the sheet 17. In the folding machine, the insert 22 is placed in any case in the required position on the sheet 17 which is then folded along the lines 94 through 97.

The folding lines 94 to 97 provide triangular sheet portions 98 to 101. First, the sheet portion 98, then the sheet portion 99, subsequently the sheet portion 100, and finally the sheet portion 101 are folded in the same direction. At two opposed sides the free edges of the folded sheet portions 100, 101 are glued to the portion of the folded envelope positioned beneath.

The folding lines 95 through 97 must not extend to the lateral edges 86, 87, 92, 93 of the sheet 17. They can be positioned at a spacing from the lateral edges 86, 87, 92, 93 of the sheet 17. In this case, the envelope is also produced by folding and subsequent gluing of the sheet 17.

As is shown in FIGS. 14 and 15, the manufacture of the inventive envelope has the advantage that for the insert or inserts 22 and the sheets 17 the same paper size can be used. Therefore, printer 84 or any other printing device must not be adjusted for printing the insert or inserts 22 and the sheet 17, respectively, it is not required to provide different printers for the insert or inserts 22 and the sheet 17.

For placement of the insert or inserts 22, the sheet 17 can be rotated in the distribution unit such that the folding lines 94 through 97 are positioned in the transporting direction of the sheet 17. This facilitates placement of the insert or inserts 22.

The specification incorporates by reference the disclosure of German priority document 198 17 878.6 of Apr. 22, 1998.

The present invention is, of course, in no way restricted to the specific disclosure of the specification and drawings, but also encompasses any modifications within the scope of the appended claims.

What I claim is:

1. An envelope comprising:

at least one sheet having four outer edges which lie at right angles to one another, said sheet folded along folding lines oriented transverse to said outer edges to create folded sheet portions, said sheet portions folded inwardly and sealed to one another along respective edges to create a sealed envelope, further comprising at least one insert inserted into the at least one sheet, wherein the at least one sheet is folded by advancing the at least one insert toward the at least one sheet.

2. An envelope according to claim 1, wherein said sheet is printed on at least one side with printing data.

3. An envelope according to claim 2, wherein said printing data is transmitted from a client through a network to a printing facility and wherein said printing data is routed through a central location.

4. An envelope according to claim 3, wherein said central location is a central data processing device.

5. An envelope according to claim 1, wherein an adhesive is used to seal said sheet portions together.

6. An envelope according to claim 1, wherein said at least one sheet is printed on at least one side.

7. An envelope according to claim 1, wherein said folded sheet portions are sealed after said at least one insert is inserted into the at least one sheet.

8. An envelope according to claim 1, wherein the insert is a pre-printed product or is printed immediately before being inserted into said at least one sheet.

9. An envelope according to claim 1, wherein said sheet includes an address printed thereon.

10. An envelope according to claim 1, wherein the at least one insert is placed onto the at least one sheet such that the sheet and the insert are positioned at a right angle to one another before said sheet is folded.

11. An envelope according to claim 10, wherein said sheet is printed on at least one side.

12. An envelope according to claim 1, wherein an address is applied to a first one, and optionally a last one, of said sheets.

13. An envelope according to claim 1, wherein said insert and said sheet have identical sizes.

14. An envelope according to claim 13, wherein the at least one insert is placed at a slant to a longitudinal side of the at least one sheet.

15. An envelope according to claim 13, wherein said insert is folded before being placed on said sheet.

16. An envelope according to claim 1, wherein the at least one sheet has DIN A4 size.

17. A method of manufacturing an envelope, said method comprising the steps of:

a) providing at least one sheet;

b) advancing an insert (22) transversely toward the sheet (17) in a folding machine having at least one pair of guiding rollers (71, 72) which grip said insert;

c) folding said sheet by transversely contacting said insert with said sheet (17), such that said insert (22) is interposed within said folded sheet;

d) gripping said folded portion of the sheet (17) with said rollers, thereby pulling said sheet with said insert (22) interposed therein through said folding machine.

* * * * *